US007079036B2

(12) United States Patent
Cooper et al.

(10) Patent No.: US 7,079,036 B2
(45) Date of Patent: Jul. 18, 2006

(54) METHOD AND APPARATUS FOR ALARM VOLUME CONTROL USING PULSE WIDTH MODULATION

(75) Inventors: Craig L. Cooper, Inola, OK (US); Toby E. Smith, Broken Arrow, OK (US)

(73) Assignee: Bed-Check Corporation, Tulsa, OK (US)

( * ) Notice: Subject to any disclaimer, the term of this patent is extended or adjusted under 35 U.S.C. 154(b) by 103 days.

(21) Appl. No.: 10/876,012

(22) Filed: Jun. 24, 2004

(65) Prior Publication Data

US 2005/0046575 A1 Mar. 3, 2005

Related U.S. Application Data

(60) Provisional application No. 60/496,501, filed on Aug. 20, 2003.

(51) Int. Cl.
*G08B 23/00* (2006.01)

(52) U.S. Cl. ..... 340/573.1; 340/573.7; 340/517; 340/392.3; 600/484; 600/485; 600/514

(58) Field of Classification Search ..... 600/500, 600/473, 514, 484, 485, 528; 340/384.4, 340/384.5, 384.6, 384.7, 392.3, 573.1, 517, 340/573.7

See application file for complete search history.

(56) References Cited

U.S. PATENT DOCUMENTS 4,179,692 A 12/1979 Vance
4,284,849 A * 8/1981 Anderson et al. ..... 379/38
4,295,133 A 10/1981 Vance
4,484,043 A 11/1984 Musick et al.
4,526,477 A * 7/1985 Murakami ..... 368/250
4,565,910 A 1/1986 Musick et al.
4,644,327 A * 2/1987 Patterson ..... 340/384.5
4,654,642 A * 3/1987 Groff ..... 340/573.1
4,700,180 A 10/1987 Vance
4,768,022 A * 8/1988 Patterson ..... 340/384.5
D361,462 S 8/1995 Newham
5,554,835 A 9/1996 Newham
5,600,108 A 2/1997 Newham
5,623,760 A 4/1997 Newham
5,633,627 A 5/1997 Newham
5,640,145 A 6/1997 Newham
5,654,694 A 8/1997 Newham
5,730,140 A * 3/1998 Fitch ..... 600/514
5,807,261 A * 9/1998 Benaron et al. ..... 600/473

(Continued)

OTHER PUBLICATIONS

Joshua Israelsohn, "Class D Gen E,", *EDN*, Apr. 15, 2004, pp. 49-58.

*Primary Examiner*—Van T. Trieu
(74) *Attorney, Agent, or Firm*—Fellers, Snider, Blankenship, Bailey & Tippens, P.C.; Terry L. Watt

(57) ABSTRACT

There is provided herein a first preferred arrangement of the instant invention, wherein an electronic patient monitor utilizes a computer CPU as an alarm signal generator, which CPU is preferably directly connected to a power amplifier and/or a speaker without an intervening (or subsequent) conventional volume control. The alarm signal is preferably expressed as a series of square waves. The volume of the alarm signal as heard through the speaker is controlled by varying the width of the square waves that represent the alarm signal with the duty cycle of the square waves being shortened to reduce the output alarm volume and lengthened to increase it.

24 Claims, 6 Drawing Sheets

U.S. PATENT DOCUMENTS 5,945,914 A 8/1999 Holmes et al.
6,065,727 A 5/2000 Fitzgerald et al.
6,111,509 A 8/2000 Holmes
6,292,102 B1 9/2001 Smith
6,307,476 B1 10/2001 Smith et al.
6,417,777 B1 7/2002 Fitzgerald et al.
6,441,742 B1 8/2002 Lovely et al.
6,544,200 B1 4/2003 Smith et al.
6,646,556 B1 11/2003 Smith et al.
6,696,653 B1 2/2004 Smith et al.
6,784,787 B1 8/2004 Atkins et al.
6,784,797 B1 8/2004 Smith et al.

* cited by examiner

METHOD AND APPARATUS FOR ALARM VOLUME CONTROL USING PULSE WIDTH MODULATION

RELATED APPLICATION

This application claims the benefit of U.S. Provisional Patent Application Ser. No. 60/496,501 filed on Aug. 20, 2003.

This invention relates generally to monitoring systems and more particularly concerns devices and systems used to monitor seated or lying patients in homes or in medical environments such as hospitals, assisted care facilities, long term care institutions, and other care-giving environments, wherein audible alarms are employed that activate upon a change in the patient's condition and wherein such alarms are designed to be adjustable in volume.

BACKGROUND OF THE INVENTION

It is well documented that the elderly and post-surgical patients are at a heightened risk of falling. These individuals are often afflicted by gait and balance disorders, weakness, dizziness, confusion, visual impairment, and postural hypotension (i.e., a sudden drop in blood pressure that causes dizziness and fainting), all of which are recognized as potential contributors to a fall. Additionally, cognitive and functional impairment, and sedating and psychoactive medications are also well recognized risk factors.

A fall places the patient at risk of various injuries including sprains, fractures, and broken bones—injuries which in some cases can be severe enough to eventually lead to a fatality. Of course, those most susceptible to falls are often those in the poorest general health and least likely to recover quickly from their injuries. In addition to the obvious physiological consequences of fall-related injuries, there are also a variety of adverse economic and legal consequences that include the actual cost of treating the victim and, in some cases, caretaker liability issues.

In the past, it has been commonplace to treat patients that are prone to falling by limiting their mobility through the use of restraints, the underlying theory being that if the patient is not free to move about, he or she will not be as likely to fall. However, research has shown that restraint-based patient treatment strategies are often more harmful than beneficial and should generally be avoided—the emphasis today being on the promotion of mobility rather than immobility. Among the more successful mobility-based strategies for fall prevention include interventions to improve patient strength and functional status, reduction of environmental hazards, and staff identification and monitoring of high-risk hospital patients and nursing home residents.

Of course, direct monitoring of high-risk patients, as effective as that care strategy might appear to be in theory, suffers from the obvious practical disadvantage of requiring additional staff if the monitoring is to be in the form of direct observation. Thus, the trend in patient monitoring has been toward the use of electrical devices to signal changes in a patient's circumstance to a caregiver who might be located either nearby or remotely at a central monitoring facility, such as a nurse's station. The obvious advantage of an electronic monitoring arrangement is that it frees the caregiver to pursue other tasks away from the patient. Additionally, when the monitoring is done at a central facility a single person can monitor multiple patients which can result in decreased staffing requirements and/or more efficient use of current staff.

Generally speaking, electronic monitors work by first sensing an initial status of a patient, and then generating a signal when that status changes, e.g., he or she has sat up in bed, left the bed, risen from a chair, etc., any of which situations could pose a potential cause for concern in the case of an at-risk patient. Electronic bed and chair monitors typically use a pressure sensitive switch in combination with a separate electronic monitor which conventionally contains a microprocessor of some sort. In a common arrangement, a patient's weight resting on a pressure sensitive mat (i.e., a "sensing" mat) completes an electrical circuit, thereby signaling the presence of the patient to the microprocessor. When the weight is removed from the pressure sensitive switch, the electrical circuit is interrupted, which fact is similarly sensed by the microprocessor. The software logic that drives the monitor is typically programmed to respond to the now-opened circuit by triggering some sort of alarm—either electronically (e.g., to the nursing station via a conventional nurse call system) or audibly (via a built-in siren) or both. Additionally, many variations of this arrangement are possible and electronic monitoring devices that track changes in other patient variables (e.g., wetness/enuresis, patient activity/inactivity, bed-exit, temperature, position, etc.) are available for some applications.

General information relating to mat-type sensors, electronic monitors and other hardware for use in patient monitoring is relevant to the instant disclosure and may be found in U.S. Pat. Nos. 4,179,692, 4,295,133, 4,700,180, 5,600,108, 5,633,627, 5,640,145, and, 5,654,694, U.S. patent application Ser. Nos. 10/701,581 and 10/617,700, U.S. Pat. Nos. 6,111,509, 6,441,742, and U.S. patent application Ser. No. 10/210,817 (the last three of which concern electronic monitors generally). Additional information may be found in U.S. Pat. Nos. 4,484,043, 4,565,910, 5,554,835, 5,623,760, 6,417,777, U.S. patent application 60/488,021, (sensor patents) and U.S. Pat. No. 5,065,727 (holsters for electronic monitors), the disclosures of all of which aforementioned patents are all incorporated herein by reference as if fully set out at this point. Further, U.S. Pat. No. 6,307,476 (discussing a sensing device which contains a validation circuit incorporated therein), U.S. Pat. No. 6,544,200, (for automatically configured electronic monitor alarm parameters), U.S. Pat. No. 6,696,653 (for a binary switch and a method of its manufacture), and U.S. patent application Ser. No. 10/125,059 (for a lighted splash guard) are similarly incorporated herein by reference.

Additionally, sensors other than mat-type pressure sensing switches may be used in patient monitoring including, without limitation, temperature sensors, patient activity sensors, patient location sensors, bed-exit sensors, toilet seat sensors (see, e.g., U.S. Pat. No. 5,945,914), wetness sensors (e.g., U.S. Pat. No. 6,292,102), decubitus ulcer sensors (e.g., U.S. Pat. No. 6,646,556), restraint device sensors (e.g., U.S. patent application No. 60/512,042), etc., all of which are incorporated herein by reference. Thus, in the text that follows the terms "mat" or "patient sensor" should be interpreted in its broadest sense to apply to any sort of patient monitoring switch or device, whether the sensor is pressure sensitive or not.

Finally, pending U.S. patent application Ser. No. 10/397,126, discusses how white noise can be used in the context of decubitus ulcer prevention and in other contexts, and U.S. patent application Ser. No. 60/543,718 teaches the use of medical feedback systems to reduce the risk of decubitus ulcer formation. Both of these references are similarly fully incorporated herein by reference.

Of particular importance for purposes of the instant disclosure are those patient monitors that contain audible alarms that are adjustable in volume. Those of ordinary skill in the art will recognize that it is desirable in many settings to control the local alarm volume of the monitor depending on, among other things, the level of ambient noise, the distance to the caregiver, etc. However, conventionally the hardware that makes up such volume controls (e.g., potentiometers, digital potentiometers, etc.) is expensive and/or prone to failure either by physical damage or internal corrosion.

Heretofore, as is well known in the patient monitoring arts, there has been a need for an invention to address and solve the above-described problems. Accordingly, it should now be recognized, as was recognized by the present inventors, that there exists, and has existed for some time, a very real need for a system for monitoring patients that contains an adjustable volume alarm with the features described hereinafter.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

In accordance with a first aspect of the instant invention, there is provided a patient sensor and electronic monitor combination that utilizes pulse width modulation ("PWM") as a means of controlling the volume of the alarm.

In a first preferred arrangement, there is provided an electronic patient monitor that utilizes a CPU as a signal generator and which is directly connected to a power amplifier without an intervening (or subsequent) conventional volume control. The microprocessor preferably creates frequency-varying square waves (or constant amplitude pulses) according to the sort of alarm desired by the user, with the duty cycle of the square waves being shortened to reduce the alarm volume and lengthened to increase it.

In another preferred arrangement, there is provided an electronic patient monitor substantially similar to that described above, but wherein the CPU directs a separate signal generator to create the series of pulses. In such a configuration, the separate signal generator will be programmed to adjust the pulse width so as to vary the alarm volume.

In still another preferred arrangement, there is provided an electronic patient monitor substantially as described above, but wherein the CPU directly drives the speaker without an intervening amplifier. As has been explained previously, the CPU will utilize PWM to control the output volume of the speaker.

In a further preferred embodiment, there is provided an electronic patient monitor substantially as described above, but wherein the square wave/pulse series takes the form of series of gating pulses that restrict the amount of audio information that reaches the amplifier and/or speaker.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Further, the disclosure that follows is intended to apply to all alternatives, modifications and equivalents as may be included within the spirit and scope of the invention as defined by the appended claims. Finally, it should be understood that the phraseology and terminology employed herein are for the purpose of description and should not be regarded as limiting, unless the specification specifically so limits the invention.

While the instant invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

BRIEF DESCRIPTION OF THE DRAWINGS

Other objects and advantages of the invention will become apparent upon reading the following detailed description and upon reference to the drawings in which.

DETAILED DESCRIPTION OF THE INVENTION

According to a preferred aspect of the instant invention, there is provided an electronic patient monitor for use with at least one patient sensor, wherein the volume of the monitor's alarm sounds is controlled by using PWM rather than via a conventional hardware volume control.

General Environment of the Invention

Figure 1:
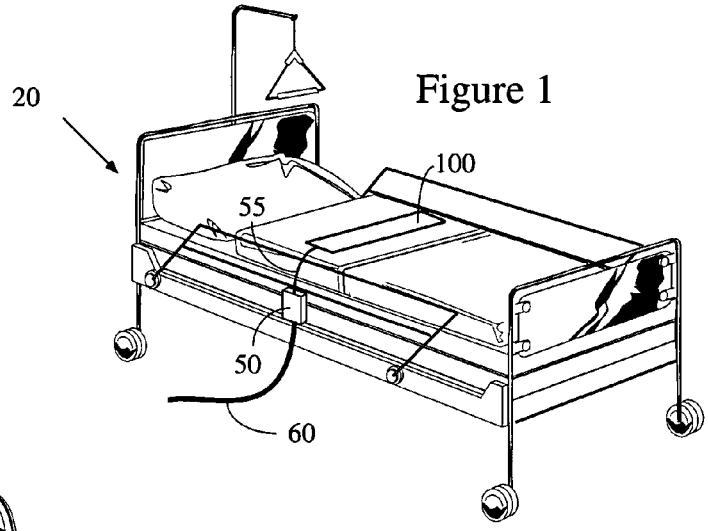
FIG. 1 illustrates the general environment of the instant invention, wherein an electronic patient monitor is connected to a bed mat.

Generally speaking, electronic patient monitors of the sort discussed herein work by first sensing an initial status of a patient, and then generating a signal when that status changes (e.g., if the patient changes position from laying or sitting to standing, if the sensor changes from dry to wet, if a temperature spike occurs, if the patient rolls, etc.) or if the status fails to change (e.g., if the patient has not moved within some predetermined time period). Turning now to FIG. 1 wherein the general environment of one preferred embodiment of the instant invention is illustrated, in a typical arrangement a pressure sensitive mat 100 sensor is placed on a hospital bed 20 where it will lie beneath a weight-bearing portion of the reclining patient's body, usually the buttocks and/or shoulders. Generally speaking, the mat 100/electronic monitor 50 combination works as follows. When a patient is placed atop the mat 100, the patient's weight compresses it, thereby closing an internal electrical circuit. This circuit closure is sensed by the attached electronic patient monitor 50 and, depending on its design, this closure may signal the monitor 50 to begin monitoring the patient via the mat 100. Additionally, in some embodiments, the monitoring phase is initiated by a manually engaged switch. Thereafter, when the patient attempts to leave the bed, weight is removed from the sensing mat 100, thereby breaking the electrical circuit, which interruption is sensed by the attached electronic patient monitor 50. The patient monitor 50, which conventionally contains a microprocessor therein, then signals the caregiver per its pre-programmed instructions. In some cases, the signal will amount to an audible alarm or siren that is emitted from the unit 50. In other cases, an electronic signal could be sent to a remote nurses/caregivers station via electronic communications line 60. Note that additional electronic connections not pictured in this figure might include a monitor power cord to provide a source of AC power although, as generally pictured in this figure, the monitor 50 can certainly be configured to be either battery or AC powered.

Figure 2:
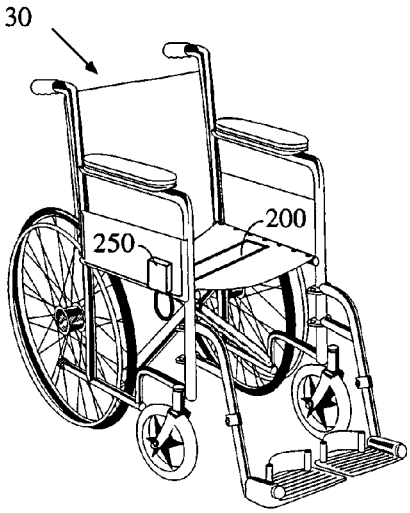
FIG. 2 illustrates the general environment of the instant invention, wherein an electronic patient monitor is connected to a chair mat.

In another common arrangement, and as is illustrated in FIG. 2, a pressure sensitive chair sensor 200 might be placed in the seat of a wheel chair or the like for purposes of monitoring a patient seated therein. As has been described previously, a typical configuration utilizes a pressure sensitive mat 200 that is connected to an electronic chair monitor 250 that is suspended from the chair 30. Because it is anticipated that the patient so monitored might choose to be at least somewhat mobile, the monitor 250 will usually be battery powered and will signal a chair-exit event via an internal speaker, rather than a hardwired nurse-call. Of course, those of ordinary skill in the art will understand that in some instances the monitor 250 will be configured to communicate wirelessly with the nurses' station through IR, RF, ultrasonic or some other communications technology.

PREFERRED EMBODIMENTS

Figure 3:
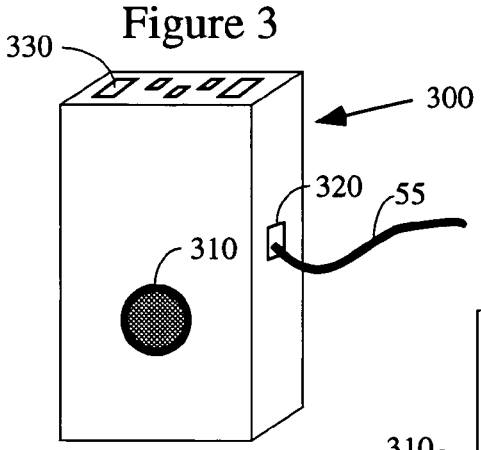
FIG. 3 contains an illustration of the main features of a preferred embodiment of the instant electronic patient monitor.

In accordance with a first aspect of the instant invention and as is generally shown in FIG. 3, there is provided a patient monitor 300 which is designed to operate without conventional volume control circuitry but which instead utilizes pulse width modulation ("PWM") to adjust the output volume level of the speaker 310.

Preferably the monitor will utilize connector 320 to interface with the patient sensor 100. In some preferred configurations the interface 320 is compatible with an RJ-11-type jack. Preferably the sensor will be a mat-type pressure sensitive sensor, however it should be clear that the type of sensor that is employed is immaterial to the operation of the instant invention. That is, no matter what form the attached sensor might take (e.g., presence/absence, position, wetness, temperature, pressure, movement, etc.) the volume adjusting portion of the instant patient monitor would operate in exactly the same fashion. As is typical in individual patient monitors, each unit is equipped with a speaker 310 through which an audio alarm may be issued.

Figure 4:
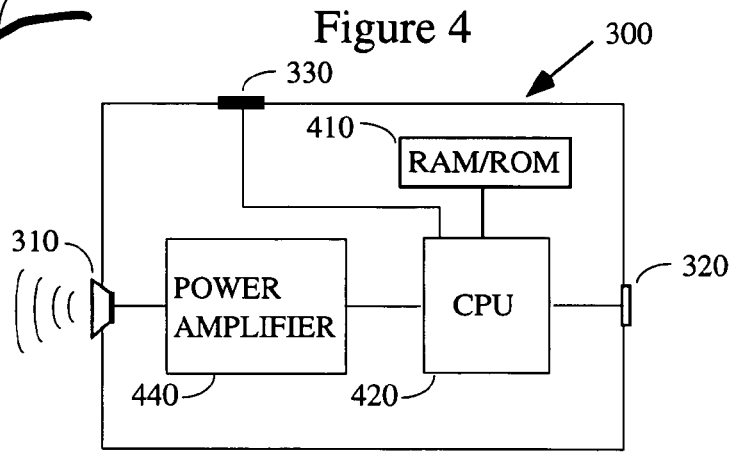
FIG. 4 is a schematic illustration of a preferred embodiment of the instant invention.

Turning now to FIG. 4 wherein a schematic diagram of a preferred embodiment is presented, the CPU 420 will have access to some amount of storage 410 which could be used to store its controlling program. Preferably, the storage 410 will take the form of non-volatile memory (e.g., ROM, flash RAM, etc.), which might be either internal or external to the CPU 420. That being said, those of ordinary skill in the art will recognize that conventional computer memory is only one of many possible storage sources that might be used and alternatives such as magnetic disk, remote hard disk (e.g., booting over a network), optical disk, magneto-optical disk, etc. Thus, for purposes of the instant invention, when the words "memory" or "storage" are used, those terms should be interpreted in the broadest sense to include any sort of electronic data storage that is accessible by the CPU 420, whether that storage is internal to the monitor 300 or external to it.

In electronic communication with CPU 420, and preferably external to it, is a power amplifier 440, the purpose of which is to amplify the signal that is sourced in CPU 420. The speaker 310 then preferably broadcasts the amplified signal in the vicinity of the monitor 300. However, those of ordinary skill in the art will recognize that the speaker 310 need not be made integral to the monitor 300, but could instead be located remotely from the CPU 420 (e.g., located in the hall outside of the patient's room, located at the nurses' station, etc.). The speaker 310 will preferably be a cone-type loudspeaker but, clearly, it could be any sort of device that can reproduce sound and that can be driven from a power amplifier 440. Additionally, the speaker 310 could certainly be a piezoelectric or similar device and, especially preferably, it will be a piezoelectric device that is driven directly from the microprocessor without an intervening amplifier (see, e.g., FIG. 10A where speaker 310 is a piezoelectric device).

In a preferred arrangement, a volume control switch 330 is provided on the exterior of the case so that the user can select from among a plurality of different volume levels. The CPU 420 is preferably placed in electronic communication with the switch 330 so that the user's volume choice can be read and acted upon. In a typical arrangement, the user will be provided with eight different volume levels (zero to 7, say) which are cycled through by repeatedly pressing switch 330. Often there will also be provided a visual indication of the selected alarm volume (e.g., an LED or similar display device) that displays the currently selected numeric volume. Preferably, the CPU 420 will control the reading and display of the selected volume information according to methods well known to those of ordinary skill in the art.

Figure 5:
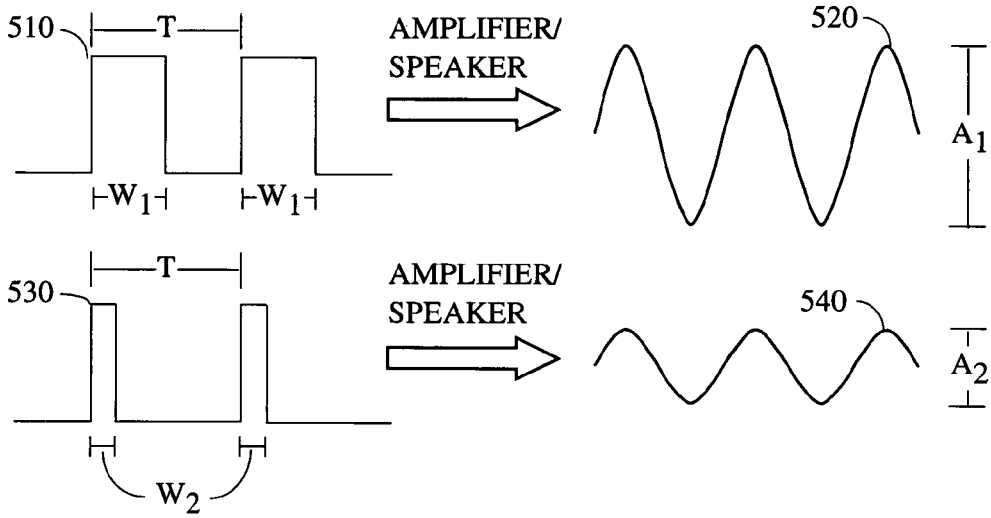
FIG. 5 illustrates in a general way how the signal pulse width is related to the output volume.

FIG. 5 illustrates a fundamental aspect of the instant invention. As is generally illustrated in that figure, the instant inventors have determined that when the pulse width of a constant frequency square-wave signal is varied, other things remaining equal, the output volume emitting from the speaker varies commensurately. Consider, for purposes of illustration, the CPU 420 generated input wave trains 510 and 530 in FIG. 5. Note that both have the same period (T) and the same amplitude, however each has a different pulse width $W_1$ and $W_2$, respectively. However, note that the amplitude of the output sounds 520 and 540 resulting from such input signals, while having the same output frequency, differ in amplitudes, i.e., $A_1$ and $A_2$, respectively. This suggests that, rather than utilizing conventional volume control hardware, the microprocessor itself can create signals which vary the output volume of the alarm In brief, the duty cycle of the input signal that is transmitted to the amplifier 440 (e.g., signals 510/530) is directly correlated with the speaker 310 output volume. Thus, by changing the duty cycle of the signal that is generated by the CPU 420, the alarm volume can be changed. Those of ordinary skill in the art will recognize that the exact volume that is produced by a particular duty cycle choice is one that can readily be determined for any particular hardware configuration and duty cycle. A preferred method of determining at least a rough correspondence is through the use of trial and error. For example, if a number of different duty cycles are selected and broadcast through the speaker 310, the resulting volumes can be measured and recorded, thereby providing a profile of the impulse-response of that particular hardware combination. Additionally, the instant inventors would note that, generally speaking, if uniformly-spaced speaker volumes are desired, the corresponding duty cycles choices are likely to be logarithmically distributed between zero and 50% duty cycle.

Figure 6:
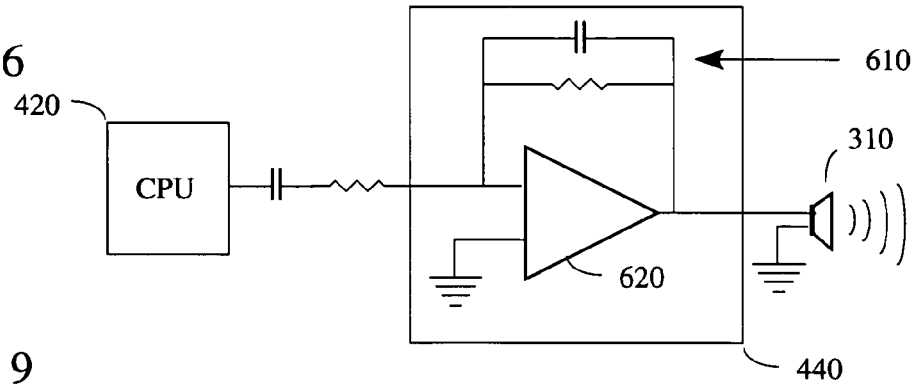
FIG. 6 is a circuit diagram of a preferred embodiment of the instant patient monitor.

A typical hardware configuration for the instant invention is set out in FIG. 6. In a preferred embodiment, an output port of CPU 420 will be routed to amplifier 620. Preferably, the output of amplifier 620 will be filtered by a low pass filter, such as RC filter 610. One purpose of this audio filter is to attenuate the resultant harmonics that are caused by the use of square waves. In the preferred embodiment, the resistor and capacitor are chosen to be 12 K ohms and 0.15 microfarads, respectively, which conventionally results in an upper frequency cutoff at 884 Hertz (i.e., $\frac{1}{2}\pi RC$), with a roll off of 3 db per octave for frequencies above that. Needless to say, the selection of the particular pass band for this filter and its roll off rate are design choices that are well within the ability of one of ordinary skill in the art to determine.

Figure 13A:
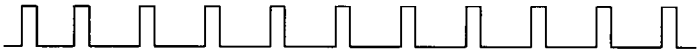
FIGS. 13A, 13B, and 13C illustrate how two time-shifted square waves can be combined to yield a signal with a minimal DC component.
Figure 13B:
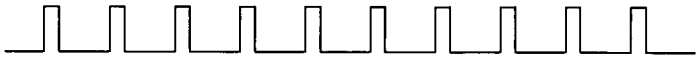
Figure 13C:
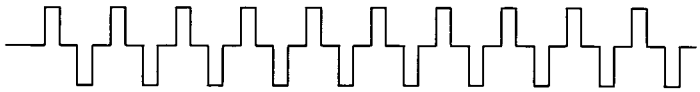
Figure 14:
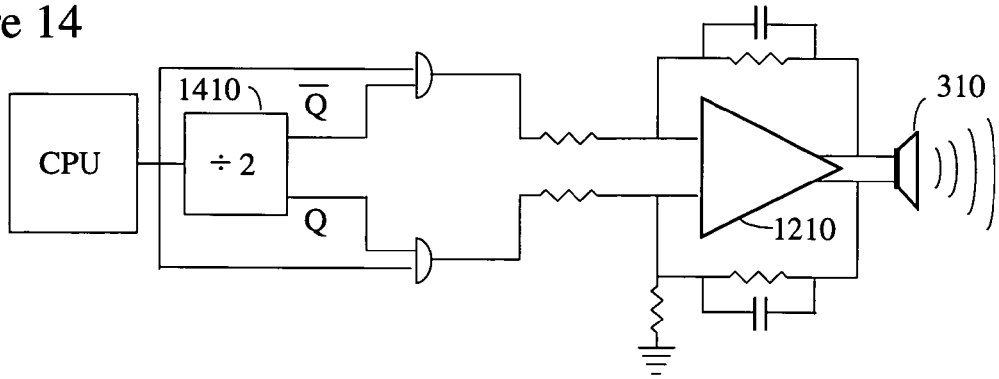
FIG. 14 contains a preferred arrangement wherein a flip-flop/logic circuit is used to produce a pair of output signals suitable for input to a differential amplifier to produce a reduced DC component signal.

Note that in another preferred arrangement and as is generally indicated in FIG. 13C, the generated square waves will alternate in sign, thereby eliminating or reducing the DC component of the signal. As those of ordinary skill in the art will recognize, if a series of positive square waves (i.e., the wave values alternate between +1 and 0) is transmitted to a speaker a DC bias will be introduced, thereby reducing the efficiency of the system. As a consequence, and according to another preferred embodiment, there is provided a patient monitor substantially as described above, but wherein the square waves alternate in sign so as eliminate or reduce the DC bias in the alarm signal. FIGS. 13A and 13B indicate how the signal of FIG. 13C can readily be constructed by combining one square wave series with a second that is a delayed and inverted version of the first. FIG. 14 illustrates a preferred hardware arrangement for creating the signal of FIG. 13C.

Figure 12:
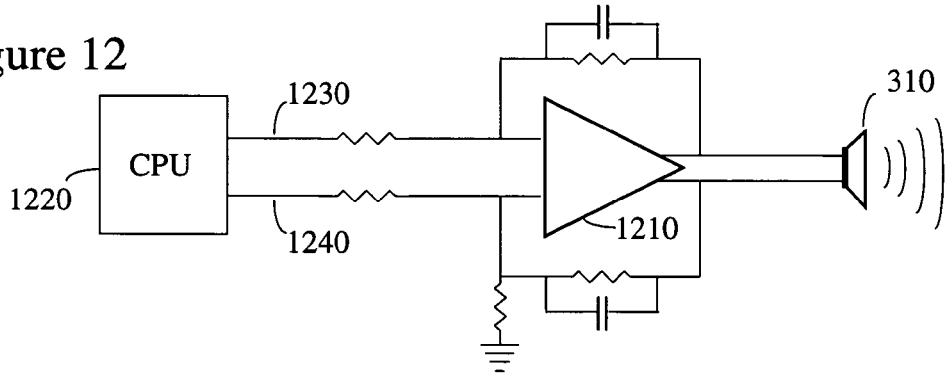
FIG. 12 contains a schematic illustration of another preferred embodiment, wherein a differential amplifier is used to create an alarm signal that has reduced DC bias.

As is generally indicated in FIG. 12, in still another preferred embodiment a differential amplifier 1210 is placed in electronic communication with a microprocessor 1220. In this embodiment, the microprocessor 1220 will preferably have two independent PWM generators therein, each of which preferably provides an output through a different port. Preferably, the signal transmitted through line 1240 will be a square wave of the same frequency as that transmitted through line 1230, but shifted by one-half of the period. This is perhaps more clearly illustrated by comparison of FIGS. 13A and 13B, wherein the second series is shifted with respect to the first. The inputs 13A and 13B will result at least approximately in the signal of FIG. 13C being sent to the speaker 310. Note that, as discussed previously, the alarm signal of FIG. 13C is symmetric about zero and, as a consequence, its DC component is at least theoretically equal to zero.

Figure 10A:
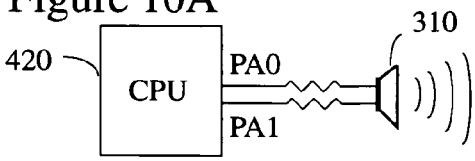
FIG. 10 illustrates some embodiments wherein the CPU is directly connected to the loudspeaker and an amplifier is not used.

Other preferred configurations are set out in FIG. 10A, wherein the power amplifier has been eliminated and instead the speaker 310 is driven directly from two ports of the microprocessor 420. In the preferred arrangement, two ports (e.g., ports PA0 and PA1) will be utilized and placed in electronic communication with the speaker terminals as is generally illustrated in FIG. 10. Preferably, of course, the microprocessor will be protected by one or more resistors as is generally illustrated in this figure. Finally, in such an arrangement it is preferred that the electrical polarity of the two chosen ports be opposite, i.e., $$PA1=(\overline{PA0}).$$

Figure 10B:
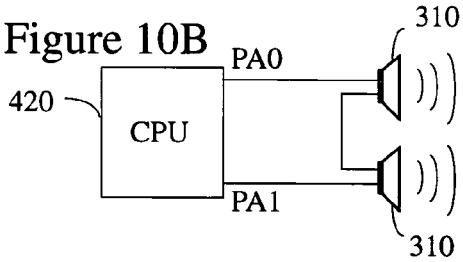
Figure 10C:
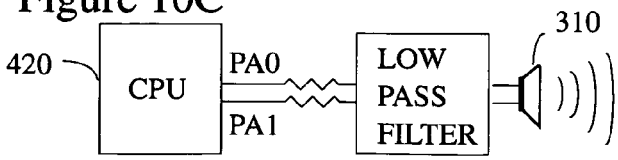

Those of ordinary skill in the art will readily recognize how an inverted square wave series in one port can simultaneously be generated in the other port. Of course, in general it would be impractical to drive large speakers at substantial volume levels with the power available from a microprocessor. However, small speakers such as those preferably utilized in connection with the instant invention can certainly be driven at some volume levels by the microprocessor 420 alone. FIG. 10B illustrates a similar arrangement, but wherein two speakers 310 are connected in series. Those of ordinary skill in the art will recognize that additional speakers beyond two could similarly be connected. Finally, FIG. 10C illustrates a preferred embodiment wherein a lower pass filter is placed between CPU 420 and the speaker 310.

Figure 11:
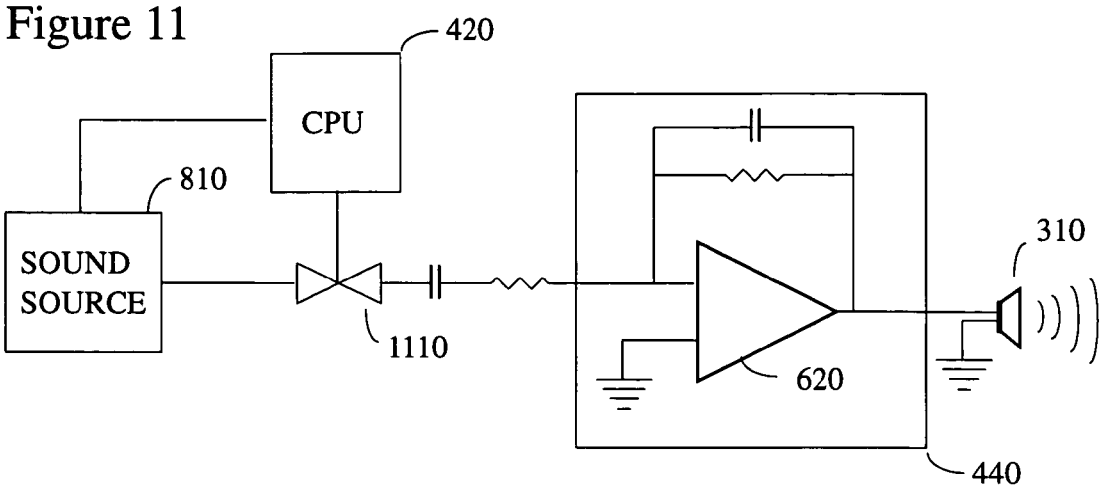
FIG. 11 contains an illustration of a preferred embodiment of the instant invention which utilizes an analog switch to control the volume of an arbitrary sound source.

According to still another embodiment, and as is generally illustrated in FIG. 11, there is provided an apparatus substantially as described above, but wherein an analog switch, electronic optical coupler, or similar electronic gating device, is used to gate an arbitrary input signal using PWM, thereby controlling its volume without the use of a separate volume control.

As is set out in FIG. 11, in a preferred arrangement a separate sound circuit 810 is used to generate an audio signal. Of course, that is not essential and those of ordinary skill in the art will recognize that it is certainly possible to use the CPU 420 for this purpose. The sound circuit 810 might be of any type including, for example, a dedicated digital signal processing ("DSP") chip, but one preferred arrangement utilizes a voice chip or similar circuitry to generate a spoken alarm. Such a voice chip might allow the user to record his or her own vocal alarm, but that is not required.

As is generally illustrated in FIG. 11, it is preferable that CPU 420 be in electronic communication with sound circuit 810 so that the microprocessor can activate/deactivate the generation of alarm sounds according to its programming. CPU 420 preferably generates a series of square waves, the pulse width of which is selected depending on the desired output volume. However, rather than routing the square wave series directly to the amplifier 440/speaker 310 as was taught previously, the square wave signal in this embodiment is used to gate the alarm that originates in sound circuit 810. That is, it is well known to those of ordinary skill in the art that an analog or digital switch 1110 is designed such that when the line between it and CPU 420 is "high" the signal from sound source 810 will be passed through unchanged. However, when the CPU 420 line is low, no information is passed on to amplifier 440. In the preferred arrangement, the square-wave series will be generated at a very high frequency, e.g. 100 kHz or so. Note further that, in contrast to the case where the square waves are directly submitted to the amplifier, in this case maximum volume is not at the 50% duty cycle mark, but rather at the point where the CPU line is constantly held "high", i.e., when the original signal is allowed to pass through unchanged. As has been described previously, when the generated pulse widths are wider, correspondingly more power will be sent through to amplifier 440 and, hence, a greater output sound volume will result. Thus, the output volume through speaker 310 will be modified in proportion to the width of the pulses generated by the CPU 420.

Figure 7:
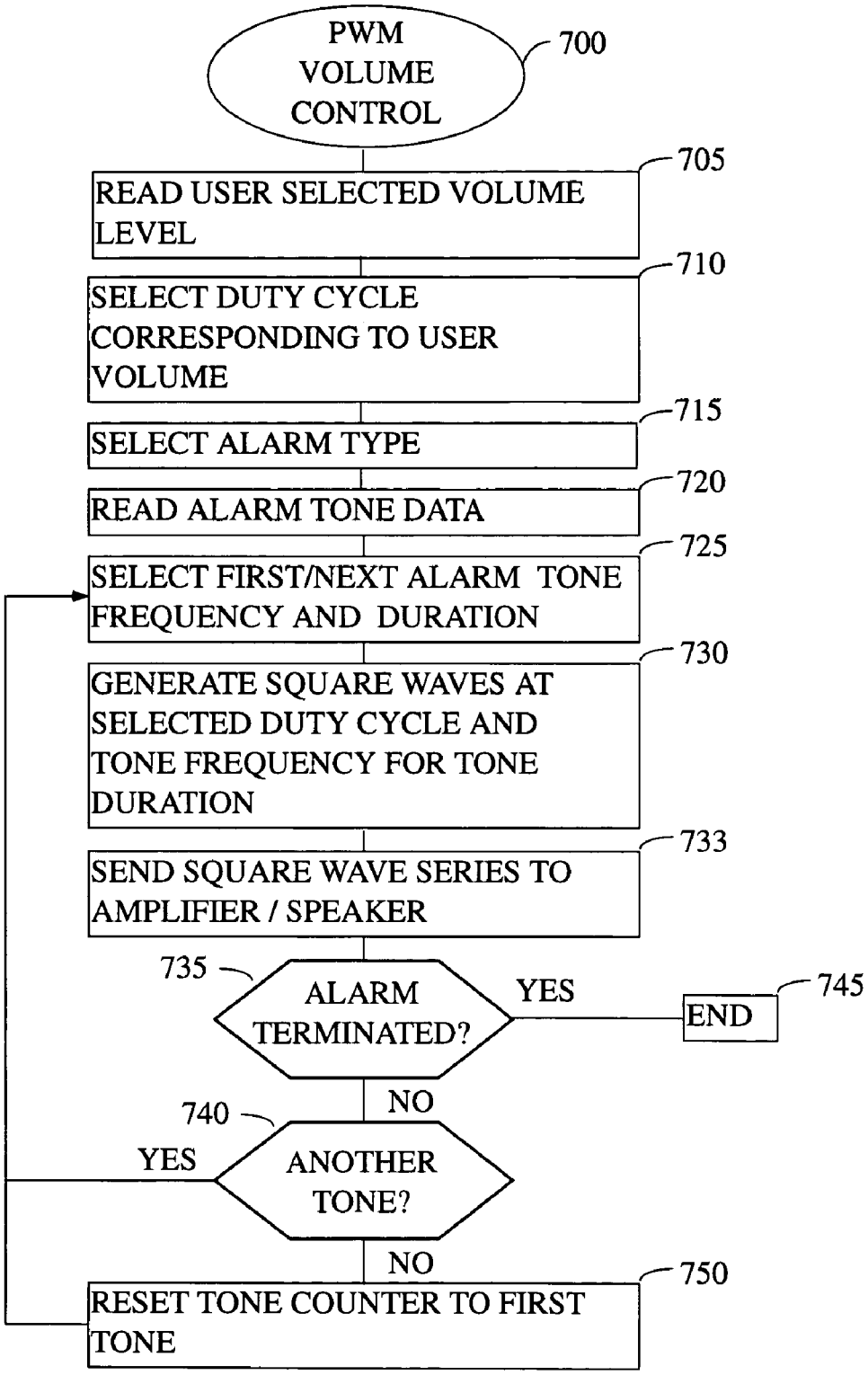
FIG. 7 contains a preferred operating logic of the inventive method taught herein.

In practice, the instant invention will preferably operate according to the method generally set out in FIG. 7. As a first preferred step in the instant PWM volume control method 700, the CPU 420 will read the user-selected volume level (step 705). The selected volume will then preferably be matched up with a corresponding duty cycle (step 710), preferably by looking up the corresponding value in a table which has previously been calculated and placed in storage 410 or elsewhere so that it may be accessed by the CPU 420. A preferred method of building a table that relates speaker volume and duty cycle has been discussed previously.

As a next preferred step 715, the CPU 420 will select an alarm type. That is, in a typical arrangement the user will be offered a selection of different alarm sounds such as sirens, warbles, swoops, songs (e.g., "Mary had a little lamb"), etc. Note that, for purposes of the instant disclosure, even if there is but a single alarm sound type provided it will be understood that it is "selected" at this step.

Once the alarm has been selected, the tone data associated with it will be read (step 720), preferably by the CPU 420. In the preferred embodiment, the tones that make up such alarms are kept in the form of a table that contains the frequency and duration of each tone such that by sequentially playing each tone for the indicated duration the desired alarm sound will be heard through the speaker 310. Those of ordinary skill in the art will recognize that this sort of arrangement is routinely utilized in this industry to store relatively simple alarm sounds. Alternatively, the alarm might consist of more complex digitized audio information (e.g., the alarm could be the prerecorded spoken message "Please get back into bed"). Note that, for purposes of the instant disclosure, when the alarm sound is an arbitrary digitized sound the "tone data" for such a sound is the individual digital sound samples together with any other parameter(s) that might be required to reproduce the sound (e.g., the sample rate). Further, in the case where the alarm sound is dynamically (e.g., algorithmically or mathematically) generated, whether within a microprocessor or within a DSP microcontroller, the tone data refers to the parameters that define such a sound. Examples of such algorithmically generated alarm sounds would include white noise-based alarms, alarms that consist of collections of simple sine or cosine waves, square waves, triangular waves, etc. The methods by which these and many other such waveforms might be generated are well known to those of ordinary skill in the art.

Figure 8:
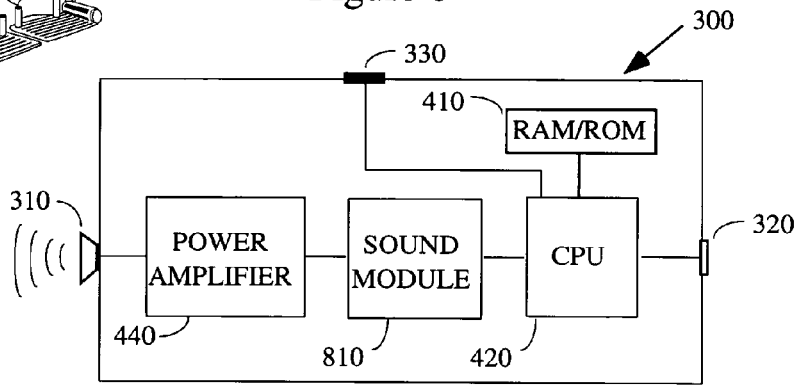
FIG. 8 illustrates preferred embodiment of the instant invention, wherein a separate sound module is utilized that is external to the CPU.

Note that, and as is illustrated in FIG. 8, it is certainly possible that the CPU 420 might be used in conjunction with a separate sound generating module 810, so that the CPU 420 would issue commands to the sound module 810 which, in turn, actually would be responsible for playing the selected alarm sound through the speaker 310 using PWM. That being said, for purposes of the instant disclosure, when the term "CPU" is used, that term should be understood and broadly construed to include the microprocessor as well as any support or other chips that are used in concert with the CPU to produce pulse width-modulated signals according to the methods of the instant invention.

Next, the preferred method enters a loop (steps 725 through 740) wherein the tones that define the alarm are successively selected, generated as a series of square waves, and transmitted to the amplifier. Step 725 selects the first or, after the loop has been entered, the next tone in the alarm definition. Preferably, the data for each tone will consist of a frequency and a tone duration. Clearly, this sort of data will be suitable to describe host of simple alarm patterns. However, in the event that the alarm is more sonically complex (e.g., a recorded or synthesized voice or an orchestral musical work), the data that is read will preferably be successive samples of a digitized audio that has been collected at a predetermined sample rate. The handling of more sonically complex alarms will be separately discussed below.

As a next preferred step 730, a series of constant frequency square waves will be generated at the frequency specified by the tone data. Thus, if the tone frequency is 440 Hz, 440 square waves will be generated per second. Note that, although such a series of square waves might readily be manually generated in software, many microprocessors contain the ability to generate square waves as a built-in software or hardware function.

The width of each square wave will be determined from the user's selected volume level in concert with the frequency of the pulses. That is, given the specified frequency the width (time duration) of each square wave can readily be determined at the maximum duty cycle of 50%. However, if the alarm volume is less than maximum, it is preferred that the width of each square wave be scaled logarithmically. Alternatively, the alarm volume might be scaled linearly, although approach typically does not produce equally spaced perceived volume changes. As a simple example, suppose that the specified frequency is 440 Hz, this would mean that at maximum volume each square wave would have a on-time of about 0.00114 seconds (0.00227/2.0), followed by the same amount of "off" time when the signal is "zero". Note, however, that would be the preferred pulse duration at full volume. At, for example, volume "3" (of 8 possible volume levels), the duration of the duty cycle could be scaled linearly from the maximum volume and calculated to be (3/8)*(0.00227 seconds) which equals approximately 0.00085 seconds. That being said, those of ordinary skill in the art will recognize that equally spaced power-level changes will not be perceived as equally spaced volume changes by the listener. Thus, it is preferred instead that logarithmic spacing of the volume levels be utilized to scale the square waves according to methods well known to those of ordinary skill in the art.

As a next preferred step, the square waves will be sequentially transmitted to the amplifier 440. In the preferred arrangement, the microprocessor will alternately set a predetermined port to high and low (i.e., "1" and "0") according to the timing calculated above. The amplifier 440 receives the sequence of square waves and then amplifies that signal for broadcast by the speaker 310.

Next, an inquiry is preferably made as to whether or not the alarm is to be terminated (step 735). If the alarm has been properly terminated, the monitor would be expected to stop its broadcast (step 745).

On the other hand, if the alarm has not been terminated, an inquiry will preferably be made as to whether there is another tone available in the tone definition for this alarm (step 740). If so, the preferred algorithm will proceed to read that tone and transmit it for the time period indicated. If there are no further tones (e.g., if the end of the song has been reached), the instant method preferably resets the tone counter (step 750) to the first tone in the alarm (e.g., the first note of the song "Mary had a little lamb") and steps 725 through 740 will be repeated as has been previously described.

Figure 9:
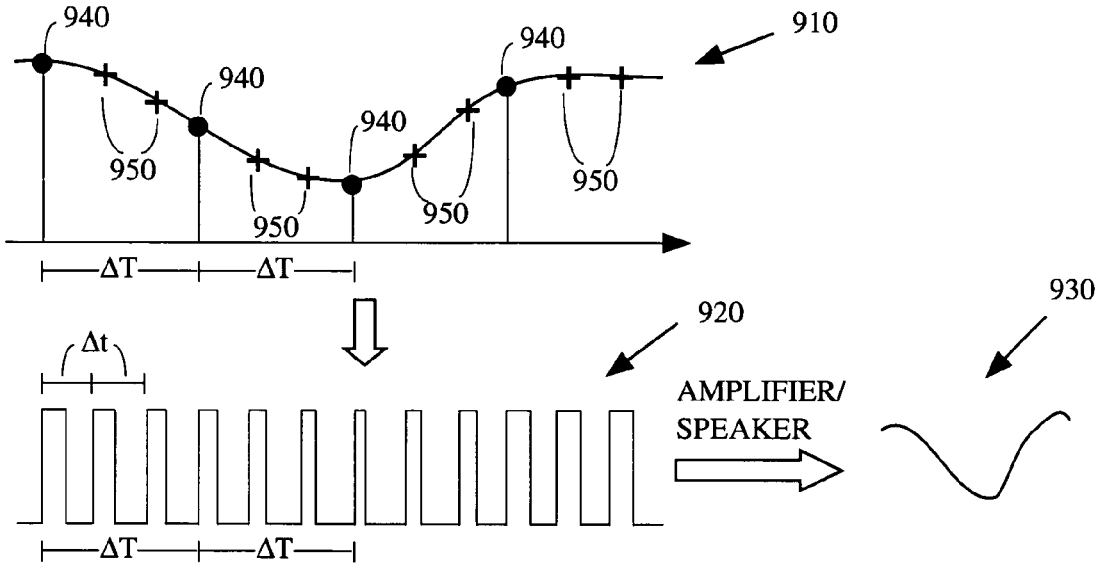
FIG. 9 contains an illustration of how the instant PWM method could be used to adjust the volume of an arbitrary sound source.

Turning now to a more complex scenario, e.g., an alarm sound that is a sampled or synthesized multi-frequency waveform, while there are many possible methods of using PWM to scale such a signal, a first preferred method is generally illustrated in FIG. 9. As is indicated in that figure, it will be assumed that the input signal 910 has been sampled and is represented by sample points 940 which have been taking at a sampling interval $\Delta T$. In such a case, a square wave sequence 920 will be created at a shorter sampling interval $\Delta t$ so that there will be N square waves per original sample, with the additional samples being generally indicated by points 950. Preferably, $\Delta t$ will be some fraction of $\Delta T$ (e.g., one-tenth) so that N will generally be defined to be equal to $\Delta T/\Delta t$ (or, 10 if $\Delta t$ is one tenth of $\Delta T$). Each original sample 910 is thus represented by N square waves. In FIG. 9, for purposes of illustration only N has been chosen to be equal to three.

Given the previous arrangement, a series of preferably equally spaced ($\Delta t$) square waves are generated, wherein the width of each square wave is determined by the amplitude of one or more of the original samples 940. That is, in FIG. 9 note that the pulse width of the first three pulses 920 is greater than that of the next three, etc., which mirrors the changes in amplitude of the original signal. Because the amplifier at least approximately acts as an integrator, the net result of amplifying and broadcasting such a signal will be that each of the original samples 910 will be reproduced via the speaker 310 at an amplitude that is proportional to the original volume, scaled, of course, by the selected overall volume level as reflected in the pulse widths. In this manner, any arbitrary sampled waveform may be utilized as an alarm and have its volume varied without the use of separate volume control circuitry.

Additionally, and preferably, rather than choosing the square wave series 920 to be of uniform pulse width, the input signal 910 will preferably be interpolated at points 950 (i.e., at sampling interval $\Delta t$) and each of the corresponding square waves in the series 920 scaled according to an interpolated value. This means that the pulse width of the square wave series 920 is continuously varied according to the instantaneous amplitude of the input signal 910. Note that, although linear interpolation was used in this case, any other form of interpolation would work as well including, without limitation, general polynomial interpolation, spline interpolation, etc. Those of ordinary skill in the art will recognize that this is just one of many ways that the volume of a sampled waveform can be controlled according to the methods taught herein.

Figure 15:
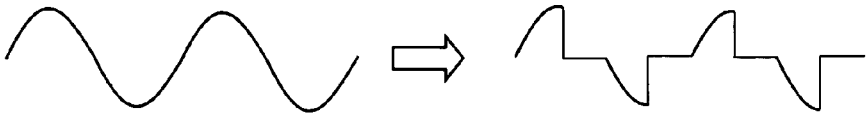
FIG. 15 illustrates a method by which PWM may be utilized in connection with an arbitrary waveform to control the volume of a patient monitor.
Figure 16A:
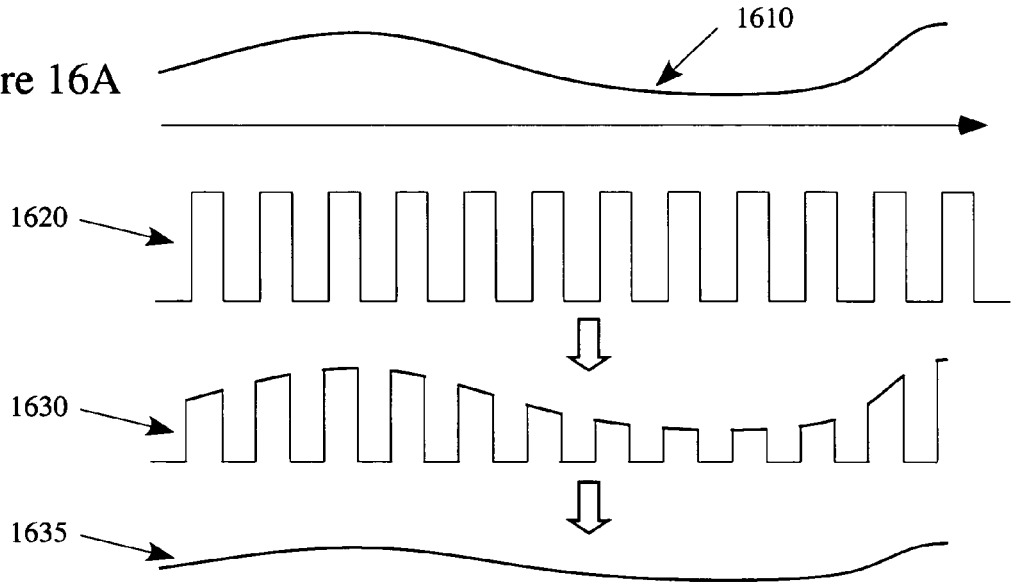
FIG. 16 contains an illustration of another preferred embodiment wherein a square wave pulse train is used to gate an arbitrary signal.
Figure 16B:
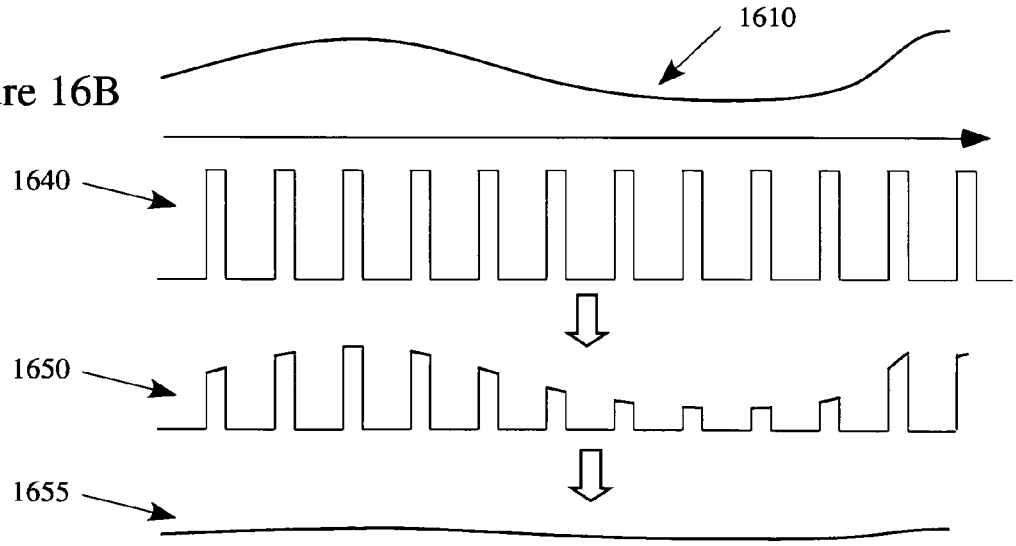

It should be noted and remembered that, although the instant invention preferably operates with square waves, in reality an arbitrary waveform can be utilized to control the speaker volume as is taught herein. That is, and in still another preferred embodiment, as is generally illustrated in FIG. 15, given an arbitrary waveform as input (left side of FIG. 15), the time-on/duty cycle of that waveform may be readily modified by gating, with the width of the gate used being proportional to the desired output volume. As can be seen in FIG. 15, the right-hand series is the same as the left-hand series, except that in the right-hand series the trailing half of each wavelet has been truncated (e.g., by gating). Note that the output volume of the speaker will be minimum when very narrow gates are used and at maximum when the gates approach a 100% duty cycle. This concept is further illustrated in FIGS. 16A and 16B. In this figure, input waveform 1610 is gated via square wave series 1620 and 1640, the second of which contains narrower gating. As can be seen, the consequences of such gating in both cases (i.e., series 1630 and series 1650) is a time series that closely resembles the input 1610, except, of course, that in the second gating (FIG. 16B) the amount of information/energy that is passed by the gate in series 1650 is less than is present in series 1630. Finally, curve 1635 is a schematic representation of the consequence of broadcasting series 1630 through a speaker. This curve should be compared with the corresponding/lower volume curve 1655 which represents the output signal that might be expected by broadcasting series 1650.

Figure 17:
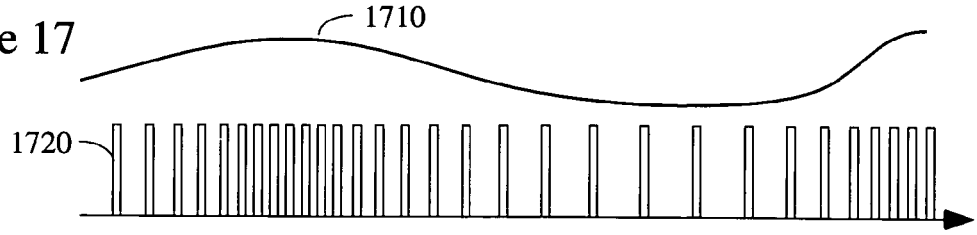
FIG. 17 illustrates a square wave time series suitable for varying the volume in a speaker to match an arbitrary waveform.

According to still another preferred embodiment, there is illustrated in FIG. 17 a variation wherein the pulse train 1720 representation of input signal 1710 is comprised of a series of equal width square waves, but wherein their spacing is related to the amplitude of the input source 1710. That is, in this arrangement constant-width square waves are utilized to represent the input signal, with the square waves coming more frequently in areas of higher amplitude. When the pulse train is broadcast through an associated speaker or amplifier/speaker combination, the energy input per unit interval of time will vary proportionally with the frequency with which the pulses arrive, thereby creating a representation of the input signal Those of ordinary skill in the art will recognize that the inverse of the pulse train 1720 more closely resembles a conventional PWM time series than does the original series.

Figure 18:
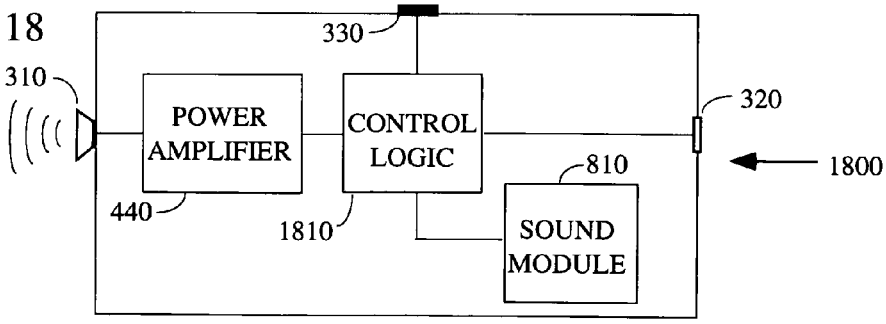
FIG. 18 contains a preferred embodiment of the instant invention which is implemented in discrete logic.

Finally, and as is generally indicated in FIG. 18, there is provided another preferred embodiment of the instant invention 1800 that is implemented without using a CPU or similar device. Those of ordinary skill in the art will recognize that a discrete logic square wave generator may readily be constructed that would be suitable to replace the CPU for purposes varying the alarm volume. In FIG. 18, one of the functions of control logic circuitry 1810 is to provide source of square waves that will be used to pulse-width modulate the output from sound circuitry 810 in preparation for transmitting the resulting signal to power amplifier 440 where it will be subsequently broadcast via speaker 310. By way of example only, the square-wave generation portion of control logic circuitry 1810 might be construed by using a ring counter to drive a D to A converter (e.g., an R-2R ladder) that feeds the trigger input of a retriggerable one-shot multi vibrator in free run mode. It should be noted that the sound circuitry 810 could be a component within the control logic circuitry 1810 or it might exist as a separate component. In one preferred embodiment, the sound circuitry 810 could be as simple as an astable multi-vibrator. In view of the foregoing, it should be understood that, although the preferred embodiment utilizes a CPU to generate square waves, that component is not strictly required and that the CPU might be replaced with a combination of discrete logic components.

CONCLUSIONS

Note that if a microprocessor is utilized as a component of the monitor 300, the only requirement that such a component must satisfy is that it must minimally be an active device, i.e., one that is programmable in some sense, that it is capable of recognizing signals from a bed mat or similar patient sensing device, and that it is capable of initiating the sounding of one or more alarm sounds in response thereto. Of course, these sorts of modest requirements may be satisfied by any number of programmable logic devices ("PLD") including, without limitation, gate arrays, FPGA's (i.e., field programmable gate arrays), CPLD's (i.e., complex PLD's), EPLD's (i.e., erasable PLD's), SPLD's (i.e., simple PLD's), PAL's (programmable array logic), FPLA's (i.e., field programmable logic array), FPLS (i.e., fuse programmable logic sequencers), GAL (i.e., generic array logic), PLA (i.e., programmable logic array), FPAA (i.e., field programmable analog array), PsoC (i.e., programmable system-on-chip), SoC (i.e., system-on-chip), CsoC (i.e., configurable system-on-chip), ASIC (i.e., application specific integrated chip), etc., as those acronyms and their associated devices are known and used in the art. Further, those of ordinary skill in the art will recognize that many of these sorts of devices contain microprocessors integral thereto. Thus, for purposes of the instant disclosure the terms "processor," "microprocessor" and "CPU" (i.e., central processing unit) should be interpreted to take the broadest possible meaning herein, and such meaning is intended to include any PLD or other programmable device of the general sort described above.

Additionally, in those embodiments taught herein that utilize a clock or timer or similar timing circuitry, those of ordinary skill in the art will understand that such functionality might be provided through the use of a separate dedicate clock circuit or implemented in software within the microprocessor. Thus, when "clock" or "time circuit" is used herein, it should be used in its broadest sense to include both software and hardware timer implementations.

Note further that a preferred electronic monitor of the instant invention utilizes a microprocessor with programming instructions stored therein for execution thereby, which programming instructions define the monitor's response to the patient and environmental sensors. Although ROM is the preferred apparatus for storing such instructions, static or dynamic RAM, flash RAM, EPROM, PROM, EEPROM, or any similar volatile or nonvolatile computer memory could be used. Further, it is not absolutely essential that the software be permanently resident within the monitor, although that is certainly preferred. It is possible that the operating software could be stored, by way of example, on a floppy disk, a magnetic disk, a magnetic tape, a magneto-optical disk, an optical disk, a CD-ROM, flash RAM card, a ROM card, a DVD disk, or loaded into the monitor over a network as needed. Additionally, those of ordinary skill in the art will recognize that the memory might be either internal to the microprocessor, or external to it, or some combination. Thus, "program memory" as that term is used herein should be interpreted in its broadest sense to include the variations listed above, as well as other variations that are well known to those of ordinary skill in the art.

Additionally, although the term "duty cycle" has occasionally been used herein in a manner that might suggest that a single-valued duty cycle (e.g., 50%) is intended by the inventors, that interpretation would unnecessarily limit the broader meaning taught by this invention. That is, and as has been discussed previously the "duty cycle" in many cases might be chosen to be a continuously varying pulse width rather than any single constant value. More generally, the "duty cycle function" could specify any arbitrary combination of time-varying pulse width and pulse separation interval, so long as the pulse train was composed of constant amplitude rectangular pulses. Thus, the phrases "duty cycle" and "duty cycle function" should be interrupted herein in the broadest possible sense to include single valued/constant duty cycles as well as arbitrarily complex time-varying duty cycle changes.

Further, it should be noted that the term "alarm" as used here should not be limited to traditional alarms and alarm sounds (e.g., sirens, warbles, etc.) but instead should be broadly construed to include any audible signal that might be broadcast by an electronic patient monitor, e.g., soothing/calming sounds (e.g., white or colored noise that is designed to mask ambient sounds), musical works, digitized speech, feedback beeps that are sounded in connection with button presses, etc.

Still further, it should be noted that when the term "square wave" is used herein, that term should not be limited to cases where the "on" time and the "off" time (i.e., the pulse separation interval) are equal but instead should be broadly construed to include any sort of constant amplitude rectangular wave or pulse that alternates between two values (e.g., between +1 V and 0 V) or between three values (e.g., between +0.5 V, 0.0 V, and −0.5 V), even if the duration of each pulse and/or the time-separation between successive pulses is not a constant value.

Additionally, it should be noted and remembered that although patient exit monitors are a preferred environment for application of the instant invention, the teachings disclosed herein have much further application. In brief, the instant invention is most suitable for use in electronic patient monitoring applications, patient feedback control systems, and similar applications.

Finally, it should be noted that the term "nurse call" as that term has been used herein should be interpreted to mean, not only traditional wire-based nurse call units, but more also any system for notifying a remote caregiver of the state of a patient, whether that system is wire-based (e.g., fiber optics, LAN) or wireless (e.g., R.F., ultrasonic, IR link, etc.). Additionally, it should be clear to those of ordinary skill in the art that it may or may not be a "nurse" that monitors a patient remotely and, as such, nurse should be broadly interpreted to include any sort of caregiver, including, for example, untrained family members and friends that might be signaled by such a system.

Thus, it is apparent that there has been provided, in accordance with the invention, a patient sensor and method of operation of the sensor that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. An electronic patient monitor for use in monitoring a patient, comprising:

(a) a speaker;

(b) an amplifier in electronic communication with said speaker, said amplifier at least for driving said speaker;

(c) a sensor responsive to a status of the patient;

(d) a CPU in electronic communication with said amplifier and with said sensor, wherein said CPU is at least for monitoring said status of the patient and sounding an alarm in response thereto; and, (e) computer storage in electronic communication with said CPU, said computer storage containing therein at least a plurality of computer instructions executable by said CPU, said plurality of computer instructions comprising the steps of:

(i) selecting a volume level, (ii) selecting a duty cycle function corresponding to said selected volume level, (iii) determining an alarm type, (iv) obtaining alarm tone data corresponding to said alarm type, (v) pulse width modulating said alarm tone data with a series of square waves generated according to said duty cycle function, thereby producing a series of audio waves at least approximately representing said selected alarm type when broadcast through said speaker, and, (vi) transmitting said series of audio waves to said amplifier for broadcast through said speaker.

2. An electronic patient monitor according to claim 1, wherein said sensor is a pressure sensitive switch.

3. An electronic patient monitor according to claim 1, wherein said CPU is chosen from a group consisting of a microprocessor, a microcontroller, a PLD, a CPLD, an EPLD, a SPLD, a PAL, an FPLA, an FPLS, a GAL, a PLA, an EPAA, a PSoC, a SoC, a CSoC, and an ASIC.

4. An electronic patient monitor according to claim 1, wherein said CPU comprises:

(d1) a microprocessor, and, (d2) a sound generation chip, said sound generation chip being in electronic communication with said microprocessor and responsive thereto, said sound generation chip at least for providing in response to said CPU said alarm tone data according to said determined alarm type.

5. An electronic patient monitor according to claim 1, wherein said computer storage is selected from a group consisting of ROM, RAM, flash RAM, PROM, EPROM, magnetic disk, optical disk, and magneto-optical disk.

6. An electronic patient monitor according to claim 1, wherein step (e)(iii) comprises the steps of:

(1) providing to a user a plurality of predefined alarm types, and, (2) reading from the user a selection of one of said plurality of predefined alarm types, thereby determining an alarm type.

7. An electronic patient monitor according to claim 1, wherein said duty cycle function is a constant 50% duty cycle.

8. An electronic patient monitor according to claim 1, wherein step e(vi) comprises the steps of filtering said series of audio waves and transmitting said series of audio waves to said amplifier for broadcast through said speaker.

9. An electronic patient monitor according to claim 8, wherein the step of filtering said series of audio waves comprises the step of filtering said series of audio waves with a band-pass filter.

10. A method of generated an alarm sound in an electronic patient monitor at a predetermined volume level, comprising the steps of:

(a) selecting a duty cycle function corresponding to said predetermined volume level;

(b) determining an alarm type;

(c) obtaining alarm tone data corresponding to said alarm type;

(d) pulse width modulating said alarm tone data with a square wave series formed according to said selected duty cycle function, thereby creating a series of audio waves at least approximately representing said selected alarm type when broadcast through a speaker; and, (e) broadcasting said series of audio waves through said speaker, thereby generating said alarm sound at approximately said predetermined volume level.

11. A method of generating an alarm sound in an electronic patient monitor according to claim 10, wherein the step of selecting a duty cycle function corresponding to said predetermined alarm volume level, comprises the step of selecting a duty cycle function corresponding to said predetermined alarm volume level, wherein said duty cycle function varies logarithmically with said selected alarm volume level.

12. An electronic patient monitor according to claim 10, wherein said duty cycle function is a constant 50% duty cycle.

13. An electronic patient monitor according to claim 10, wherein said series of audio waves is a series of square waves.

14. An electronic patient monitor for use in monitoring a patient, comprising:

(a) a speaker;

(b) a sensor positionable to be proximate to the patient and responsive to a status of the patient when so positioned;

(c) a CPU in electronic communication with said sensor and with said speaker, said CPU being at least for (c1) monitoring said status of the patient via said sensor, and, (c2) generating at least one alarm in response to a change in said patient status;

(d) computer storage in electronic communication with said CPU, said computer storage containing therein at least a plurality of computer instructions readable by said CPU and executable thereby, said plurality of computer instructions at least comprising the steps of:

(i) using said sensor to determine that a change in the patient's status has occurred;

(ii) selecting a volume level, (iii) selecting a duty cycle function corresponding to said selected volume level, (iv) determining an alarm type, (v) obtaining alarm tone data corresponding to said alarm type, (vi) generating a series of audio waves according to said duty cycle function, said alarm type and said tone data, said series of audio waves at least approximately representing said selected alarm type when broadcast through said speaker, and, (vi) transmittng said series of audio wave to said speaker, thereby creating an audible representation of said determined alarm type.

15. An electronic patient monitor according to claim 14, wherein said sensor is a pressure sensitive switch.

16. An electronic patient monitor according to claim 14, further comprising:

(e) an amplifier in electronic communication with said speaker and with said CPU, said amplifier at least for receiving said audio waves and driving said speaker with said audio waves.

17. An electronic patient monitor according to claim 14, wherein said CPU comprises:

(c1) a programmable microprocessor, and, (c2) a sound generation module in electronic communication with said microprocessor, said sound generation module at least for providing said alarm tone data of step (v) to said microprocessor.

18. An electronic patient monitor according to claim 14, wherein said duty cycle function is a constant 50% duty cycle.

19. An electronic patient monitor according to claim 14, wherein said CPU is a microprocessor and wherein said computer storage is located within said microprocessor.

20. An electronic patient monitor according to claim 14, wherein step d(vi) comprises the steps of:

(v1) selecting a duty cycle function corresponding to said selected volume level, said duty cycle function specifying at least one square wave width and at least one pulse separation interval, and, (v2) calculating a square wave representation of at least a portion of said tone data from said at least one square wave width and said at least one intra-pulse interval, thereby generating a series of audio waves at least approximately representing said selected alarm type when broadcast through said speaker.

21. An electronic patient monitor according to claim 14, wherein step d(vi) comprises the steps of:

(v1) selecting a duty cycle function corresponding to said selected volume level, said duty cycle function specifying at least one square wave width and at least one pulse separation interval, and, (v2) gating said tone data according to said duty cycle function, thereby generating a series of audio waves at least approximately representing said selected alarm type when broadcast through said speaker.

22. An electronic patient monitor for use in monitoring a patient, comprising:

(a) a patient sensor, said patient sensor being positionable to be proximate to the patient and responsive to a state of the patient when so positioned;

(b) a speaker;

(c) sound circuitry, said sound circuitry at least for creating at least one audio alarm signal;

(d) a control logic circuit in electronic communication with said speaker, said patient sensor, and said sound circuitry, said control logic circuit being at least for (d1) responding to a predetermined change in the state of the patient to sound an alarm, (d2) receiving said one of said audio signals from said sound circuitry when said alarm is to be sounded, (d3) pulse width modulating said received audio signal, thereby setting a volume level of said audio alarm signal, and (d4) transmitting said pulse width modulated signal to said speaker.

23. An electronic patient monitor according to claim 22, wherein said patient sensor is a pressure sensitive switch.

24. An electronic patient monitor according to claim 22, wherein said control logic circuit is a microprocessor.

* * * * *